US010937613B2

(12) United States Patent
Desmond et al.

(10) Patent No.: US 10,937,613 B2
(45) Date of Patent: Mar. 2, 2021

(54) TRIGGERED GAP SWITCHING DEVICE

(71) Applicant: S&C Electric Company, Chicago, IL (US)

(72) Inventors: Daniel Desmond, Chicago, IL (US); Ciprian Gavrincea, Wadsworth, IL (US); Raphael Guio, Barrington, IL (US); Sigurd A. Nelson, II, Glencoe, IL (US); Marc Witham, Chicago, IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 16/742,978

(22) Filed: Jan. 15, 2020

(65) Prior Publication Data

US 2020/0258703 A1 Aug. 13, 2020

Related U.S. Application Data

(60) Provisional application No. 62/804,297, filed on Feb. 12, 2019.

(51) Int. Cl.
*H01H 33/664* (2006.01)
*H01H 33/14* (2006.01)

(52) U.S. Cl.
CPC ..... *H01H 33/664* (2013.01); *H01H 33/14* (2013.01)

(58) Field of Classification Search
CPC .... H01H 33/664; H01H 33/14; H01H 33/168; H01H 33/6661; H01H 33/143; H01H 33/6664; H01H 33/6665; H01H 2033/6665; H01H 9/541; H01H 9/542; H01H 2009/546; H01H 9/0038; H01H 33/122
USPC ..... 218/118; 315/111.41
See application file for complete search history.

(56) References Cited

U.S. PATENT DOCUMENTS 4,130,782 A * 12/1978 Dethlefsen ..... H01H 33/664 218/141
4,713,644 A * 12/1987 Nash ..... H01H 85/047 218/118
4,978,893 A * 12/1990 Brannon ..... H01T 2/00 313/311
5,075,594 A * 12/1991 Schumacher ..... H01J 17/063 250/423 R (Continued)

FOREIGN PATENT DOCUMENTS

EP 2736060 * 11/2012 ..... H01H 33/59

*Primary Examiner* — William A Bolton

(57) ABSTRACT

A switch assembly for high voltage applications, where the switch assembly includes a traditional mechanical switch and a triggered gap device electrically coupled in parallel. The mechanical switch includes a first switch contact and a second switch contact, where one or both of the first switch contact and the second switch contact are movable to engage and disengage the first and second switch contacts to allow or prevent current flow therethrough. The triggered gap device includes a vacuum enclosure, a first stationary contact positioned within the enclosure and a second stationary contact positioned within the enclosure, where a gap is defined between the first and second stationary contacts. The triggered gap device further includes a plasma control device that allows creation of a plasma in the gap that causes an arc between the stationary contacts on the order of micro-seconds that allows current flow between the contacts.

20 Claims, 2 Drawing Sheets

(56) References Cited

U.S. PATENT DOCUMENTS 5,545,947 A * 8/1996 Navaroli ..... H01J 17/10
313/293
5,665,166 A * 9/1997 Deguchi ..... C23C 16/5096
118/723 E
5,828,176 A * 10/1998 Goebel ..... H01J 17/14
315/111.41
8,861,144 B2 * 10/2014 Shea ..... H01T 2/02
361/117

* cited by examiner

TRIGGERED GAP SWITCHING DEVICE

CROSS-REFERENCE TO RELATED APPLICATION

This application claims the benefit of priority from the U.S. Provisional Application No. 62/804,297, filed on Feb. 12, 2019, the disclosure of which is hereby expressly incorporated herein by reference for all purposes.

BACKGROUND

Field

This disclosure relates generally to a switch assembly for high voltage applications and, more particularly, to a switch assembly for high voltage applications that includes a traditional mechanical switch and a triggered gap device electrically coupled in parallel.

Discussion of the Related Art

An electrical power distribution network, often referred to as an electrical grid, typically includes a number of power generation plants each having a number of power generators, such as gas turbines, nuclear reactors, coal-fired generators, hydro-electric dams, etc. The power plants provide power at a variety of medium voltages that are then stepped up by transformers to a high voltage AC signal to be provided on high voltage transmission lines that deliver electrical power to a number of substations typically located within a community, where the voltage is stepped down to a medium voltage. The substations provide the medium voltage power to a number of three-phase feeder lines. The feeder lines are coupled to a number of lateral lines that provide the medium voltage to various distribution transformers, where the voltage is stepped down to a low voltage and is provided to a number of loads, such as homes, businesses, etc.

Power distribution networks of the type referred to above include a number of switching devices, breakers, reclosers, interrupters, etc. that control the flow of power throughout the network. Some of these switches are high voltage switches or circuit breakers, for example, switches that operate at 40,000 volts and higher, which may be employed in a substation or elsewhere. These high voltage switches are typically mechanical devices that include two contacts, where one or both are movable, that are actuated to engage or disengage from each other to connect or disconnect the circuit by various techniques, such as electromagnetic actuators, springs, hydraulics, etc.

Although the known switches for high voltage applications have generally performed successfully, they can be improved. For example, improvements in mechanical scatter can be provided, which is defined as the consistency over time of multiple operations of the switch, i.e., how accurately the switch connects and disconnects after extended use. More specifically, when a high voltage switch of this type is mechanically closed, where one of the contacts is receiving a high voltage AC signal, the timing of when current conducts across the switch relative to the orientation of the sine wave of the AC signal, known in the art as point on wave closing, determines how the circuit reacts to the start of current flow. In other words, the location in the AC cycle of the signal determines whether the current conducting across the switch is very high, or not, where high current may add unnecessary stress on the various circuit components. Therefore, it is often desirable to try to cause the initial conduction of the switch when it is closed to be at a time when the AC voltage cycle is near its peak.

A vacuum interrupter is a switch that has particular application in electrical systems, and employs opposing contacts, one fixed and one movable, positioned within a vacuum enclosure. When the vacuum interrupter is opened by moving the movable contact away from the fixed contact, the arc between the contacts is quickly extinguished due to the nature of vacuum as an insulator, as well as the design of other components within the vacuum interrupter. A vapor shield is provided around the contacts to contain the dispersion of molten contact material due to arcing. For certain applications, the vacuum interrupter is encapsulated in a solid insulation housing that has a grounded external surface.

A fault interrupting switch that closes to test for the presence of fault current is known to be employed in medium voltage networks. Specifically, if a fault current is detected in the network the fault interrupting switch is opened in response thereto, and then immediately pulsed closed for a duration less than one half of one AC cycle, and then opened to determine if the fault current is still present. Currently, a reclosing operation may be performed in response to a fault in high voltage applications, where a circuit breaker is opened and subsequently closed to determine if the fault is still present. In this situation, the breaker is typically closed and conducting current for multiple AC cycles. It may be beneficial to employ fault interrupting switches that utilize pulse testing in the high voltage part of the network to detect when fault current is present as it limit stress on the overall system, among other benefits, as compared to reclosers. However, it is difficult to scale up the known fault interrupting switches to high voltage applications because of physical limitations of the switches, and more specifically, vacuum interrupters.

SUMMARY

The following discussion discloses and describes a switch assembly that includes a traditional mechanical switch and a triggered gap device electrically coupled in parallel, where the switch assembly has application for high voltage switching. The mechanical switch includes a first switch contact electrically coupled to a first electrical connection and a second switch contact electrically coupled to a second electrical connection, where one or both of the first switch contact and the second switch contact are movable to engage and disengage the first and second switch contacts to allow or prevent current flow between the first and second electrical connections. The triggered gap device includes a vacuum enclosure, a first stationary contact positioned within the enclosure and being electrically coupled to the first electrical connection and a second stationary contact positioned within the enclosure and being electrically coupled to the second electrical connection, where a gap is defined between the first and second stationary contacts. The triggered gap device further includes a plasma control device that is operable to energize a small cathode spot on one or both of the stationary contacts that emits a metal vapor into the gap that allows an arc across the gap that allows current flow between the first and second electrical connections, wherein the plasma control device is triggered at a particular angle of an AC power signal and the plasma is naturally extinguished at a next zero crossing of the AC power signal.

Additional features of the disclosure will become apparent from the following description and appended claims, taken in conjunction with the accompanying drawings.

DETAILED DESCRIPTION OF THE EMBODIMENTS

The following discussion of the embodiments of the disclosure directed to a high voltage switch assembly including a mechanical switch and a triggered gap device electrically coupled in parallel is merely exemplary in nature, and is in no way intended to limit the invention or its applications or uses. For example, as mentioned, the discussion herein describes the switch assembly for high voltage applications. However, as will be appreciated by those skilled in the art, the switch assembly may have other applications.

Figure 1:
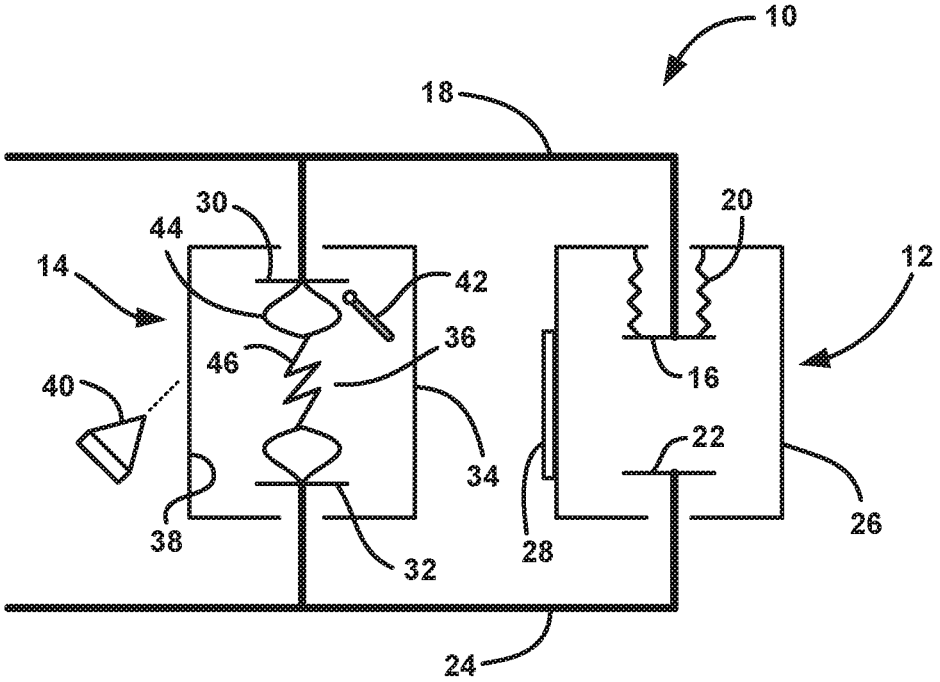
FIG. 1 is a schematic type diagram of a high voltage switch assembly including a mechanical switch and a triggered gap device electrically coupled in parallel, where contacts in the mechanical switch are open and an arc is shown across stationary contacts in the gap device.

FIG. 1 is a schematic type diagram of a high voltage switch assembly 10 including an insulated mechanical switch 12 and a triggered gap device 14 electrically coupled in parallel. The mechanical switch 12 includes an upper movable contact 16 electrically coupled to an upper electrical connection 18, and being attached, in this non-limiting embodiment, to a bellows 20, and a lower stationary contact 22 electrically coupled to a lower electrical connection 24, where the contacts 16 and 22 are enclosed within an outer housing 26 and are shown in the open position. When the contacts 16 and 22 are closed by any suitable device 28, current can flow from the connection 18 to the connection 24, or vice versa. The mechanical switch 12 is intended to represent any high voltage switch suitable for the purposes discussed herein, such as a gas insulated switch, a vacuum interrupter switch, etc. It is noted that although the upper contact 16 is described as being movable and the lower contact 22 is described as being stationary this is merely for illustration purposes in that either or both of the contacts 16 and 22 can be movable. The triggered gap device 14 includes an upper stationary contact 30 electrically coupled to the upper electrical connection 18, and a lower stationary contact 32 electrically coupled to the lower electrical connection 24, where a gap 36 is defined between the contacts 30 and 32, and where the contacts 30 and 32 are enclosed within an outer enclosure 34 that provides a vacuum chamber 38 in which the contacts 30 and 32 are positioned.

The triggered gap device 14 is designed so that a plasma can be created in the vacuum chamber 38 at a specific point in time in response to one or both of a plasma control device being energized in the contacts 30 and 32. The plasma control device can be any device suitable for the purposes described herein, such as a laser 40 that emits a laser beam onto one or both of the stationary contacts 30 and 32 or a spark electrode 42 that provides an energizing spark inside of the chamber 38 in close proximity to one or both of the contacts 30 and 32. It is noted that the laser 40 is intended to represent one laser for one of the contacts 30 or 32 or two lasers one for each of the contacts 30 and 32, and the spark electrode 42 is intended to represent one spark electrode for one of the contacts 30 or 32 or two spark electrodes one for each of the contacts 30 and 32. The laser beam from the laser 40 or the spark from the spark electrode 42 energizes a small spot on one or both of the contacts 30 and 32, sometimes referred to herein as a cathode spot, that emits a metal vapor into the gap 36 as a plasma 44. More specifically, the laser beam is capable of ablating a microscopic portion of metal, thus initiating a cathode spot, and the electrode 42 can receive a separate controllable voltage that can induce a breakdown on the contact 30 or 32 and form the cathode spot. If an AC power signal is being applied to one of the contacts 30 or 32, the plasma 44 allows the device 14 to conduct current across the gap 36 from the contact 30 to the contact 32 by an arc 46 created within the vacuum. The laser 40 would be positioned external to the chamber 38, where the laser beam would be transmitted through a window (not shown) in the enclosure 34. The spark electrode 42 would be positioned internal to the chamber 34.

Figure 2:
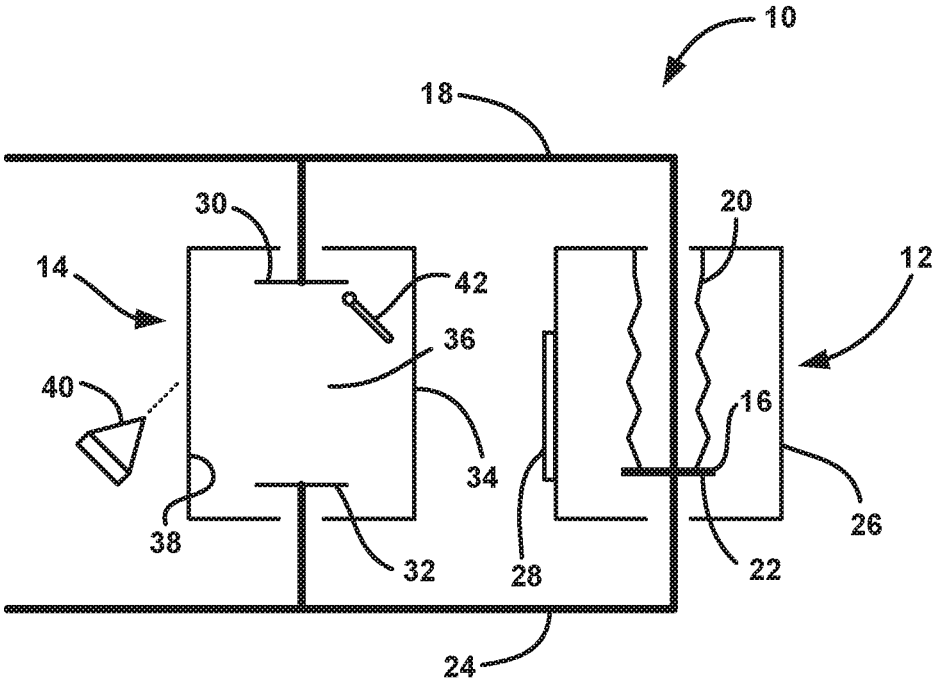
FIG. 2 is a schematic block diagram of the high voltage switch assembly shown in FIG. 1, where the contacts in the mechanical switch are closed and no arc is shown across the stationary contacts in the gap device.

Once the current flow in the device 14 begins it does not stop until the AC current signal on the contact 30 cycles through a zero point of the AC signal. When this occurs, the cathode spot is extinguished by the vacuum and the arc 46 dissipates. Because the plasma 44 can be ignited in the chamber 38 by the laser beam or the spark, the timing of when the device 14 conducts can be tightly controlled, i.e., on the order of micro-seconds. Further, because the contacts 30 and 32 don't move, there is not a requirement for an accurate mechanical actuation. Thus, while the device 14 is conducting current for a brief period of time, the mechanical switch 12 can be actuated to the closed position, where it is not necessary for the mechanical actuation of the switch 12 to be as precise and as fast as would be desired if the triggered gap device 14 is not included. More particularly, since the mechanical switch 12 needs to be large and robust for the high voltage applications, it is sometimes difficult for the switch 12 to be closed, which is not required by including the device 14. Therefore, once the arc 46 is extinguished in the chamber 38, electrical conduction is made through the switch 12. FIG. 2 is a schematic type diagram of the switch assembly 10 showing the switch 12 in a closed position, where the contacts 16 and 20 are in contact with each other and the plasma 44 has dissipated.

The triggered gap device 14 is described herein as being similar to a vacuum interrupter. However, the key properties of the device 14 include that conduction can begin on the order of micro-seconds (μs) from the time a decision is made to initiate conduction, the device 14 will interrupt the current at a current zero point, the inherent resistance of the device 14 while conducting is low compared to the traditional mechanical device when interrupting, that contact welding between the contacts 30 and 32 can never occur at initiation or extinction of current flow because no physical movements are required, and that when not conducting, the device 14 can withstand very high nominal and transient voltages without breaking down. In some instances, a solid state device such as a thyristor may also have these properties.

A key property of the triggered gap device 14 is that the technique for initiating the cathode spot on the contact 30 or 32 is very fast and has more accurate timing than a mechanical technique. The timing of the plasma control device can be controlled much better than the mechanical touching of the mechanical switch 12. Even the best mechanical switching device has difficulty controlling electrical connection better than +/−1 ms, i.e., +/−20 degrees on a 60 Hz cycle. However, the triggered gap device 14 can easily achieve timing of +/−10 μs, i.e., +/−0.2 degrees on a 60 Hz cycle, and often the time accuracy is significantly better. Due to the nature of the spacing between the contacts 30 and 32 and a vacuum of $10^{-5}$ mbar or less in the chamber 38, the triggered gap device 14 can withstand very high voltages when the cathode spot is not present. It may be possible to actually combine both the device 14 and the mechanical switch 12 into a single device, such as a vacuum interrupter with additional electrodes, and this may reduce complexity for some applications.

Based on the discussion above, it is apparent that the switch assembly 10 has three modes, namely, the switch assembly 10 starts open and then closes, the switch assembly 10 starts closed and then opens, and the switch assembly 10 is pulsed where the switch 12 is held open when the device 14 is triggered.

The timing of the electrical closing of the triggered gap device 14 to mitigate transients will be much more accurate, so that functions such as capacitor bank switching, line charging, and transformer switching can occur with much less disturbance to the system. In the context of a larger circuit, for example, long transmission lines and capacitor banks, the exact time a circuit breaker or switch closes on a 60 Hz AC voltage power line determines the magnitude of the transient voltages and current rushes. It is desirable to mitigate these high current and voltage magnitudes so that they don't cause problems with interruption and withstand ratings. This concept is also known as "controlled switching" or "point on wave" switching and is used in several areas including switching of capacitor banks, back-to-back capacitor switching, switching on shunt reactors, transformer energization, and occasionally general switching of transmission lines and distribution feeders. However, the current state of the art for controlled switching other than expensive solid state switches usually has an accuracy of +/−20 degrees (1 msec). The proposed switch assembly 10 should be able to improve this accuracy by more than an order of magnitude, i.e., possibly +/−0.2 degrees or 10 μsec.

The closing operation of the switch assembly 10 for the first mode referred to above, and already generally described, operates to minimize transient voltages and currents, and can further be described as follows. The process starts with the contacts 16 and 22 in the switch 12 being open. The arc 46 is initiated in the triggered gap device 14 using the plasma control device, which is done with highly accurate timing, so that conduction begins at a specific point on the AC voltage waveform. The mechanical contacts 16 and 22 now have much more time to close for long term bulk conduction. The nature of the triggered gap device 14 allows conduction to continue across the gap 36 until the mechanical mechanism engages the contacts 16 and 22. Once the mechanical contacts 16 and 22 are electrically closed, current naturally flows through them, and the arc 46 in the triggered gap device 14 will extinguish.

The switch assembly 10 has unique abilities that can be taken advantage of when opening and breaking a circuit for the second mode of operation referred to above. For example, it is possible to break the circuit faster than and divert the current away from the contacts 16 and 22 than in previous switches, which should lead to less wear of the contacts 16 and 22, less arcing in the insulating medium, i.e., by-products of arced sulfur hexafluoride ($SF_6$), potential clearing times of less than two power-frequency cycles, the potential use of non-$SF_6$ insulating mediums in certain gas switchgear, the potential elimination of any pressurized gas, and the potential to use air as the insulating medium. The current state of the art of switches, i.e., the $SF_6$ puffer and $SF_6$ self-blaster gas switches, require extra time and travel distance to compress the $SF_6$ in the switch 12 before the contacts 16 and 22 separate as discussed by the following process for the first mode.

The contacts 16 and 22 begin the switching operation closed. Just prior to the instant that the mechanical contacts 16 and 22 open, the plasma control device ignites the triggered gap device 14 and fills the vacuum chamber 38 with the neutrally charged conductive plasma 44, and does so in a way that the plasma 44 stays intact as the contacts 16 and 22 in the mechanical switch 12 separate. As the contacts 16 and 22 separate, a voltage is induced across the gap 36. Since the chamber 38 is filled with the plasma 44, and since the cathode spots are kept active, the device 14 conducts the electricity required, and keeps the voltage across the contacts 16 and 22 low, i.e., on the order of tens of volts. Current continues to flow through the triggered gap device 14, thus allowing the contacts 16 and 22 to reach a safe distance apart so that the gap between the contacts 16 and 22 will not break down at a suitably high voltage. The cathode spots in the triggered gap device 14 continue to conduct and produce the plasma 44 until the circuit reaches a natural current zero. Once a natural current zero is reached, the cathode spots die and current is interrupted naturally. Because the voltage across the gap 36 will max out at about 10 V when conducting, this represents the maximum voltage across the contacts 16 and 22, and little or no arc will be drawn out in the mechanical switch 12. Thus, there is little or no wear from the arc 46, but obviously there will be some mechanical wear, which is much less, and the contacts 30 and 32 in the chamber 38 will likely live through hundreds or thousands of interruptions. Additionally, there will be little or no by-products given off in the insulating medium around the contacts 16 and 22.

Finally, as long as the contacts 16 and 22 are a safe distance away, the current flow will be broken at the next current zero, which is much quicker than other technologies available at voltages above which modern vacuum interrupter works, i.e., $SF_6$ puffer and self-blaster switches require at least 1 to 1.5 cycles to compress $SF_6$ prior to parting the contacts 16 and 22 for interruption, which is the present technology above 100 kV. Furthermore, the steps outlined don't necessarily require $SF_6$ to be the insulating medium in the switch 12. The only required properties are that the arc voltage is sufficiently higher than the vacuum arc voltage, and that the dielectric strength is sufficient for the gap when the current is finally interrupted. Also, the dielectric withstand of the gap between the contacts 16 and 22 scales with the square root of the distance, so this technique can scale to all commercially used voltages provided that the electrodes are simply far enough apart.

Another aspect of the controlled switching provided by the switch assembly 10 for the controlled opening mode is withstanding transient recovery voltages (TRV). The current state of the art for known switches includes delaying the start of separating the contacts 16 and 22 to ensure that they are far enough apart when the current stops to withstand TRV, for example, controlling the timing of breaking of a circuit to minimize the possibility of TRV leads to less restrikes after interruption. In other words, if the contacts 16 and 22 are not far enough apart when a current zero occurs, the transients can sometimes cause a restrike. To accomplish the same effect, the proposed switch assembly 10 can continue to energize the gap 36, which will ensure conduction until the bulk contacts are sufficiently far apart.

Figure 3:
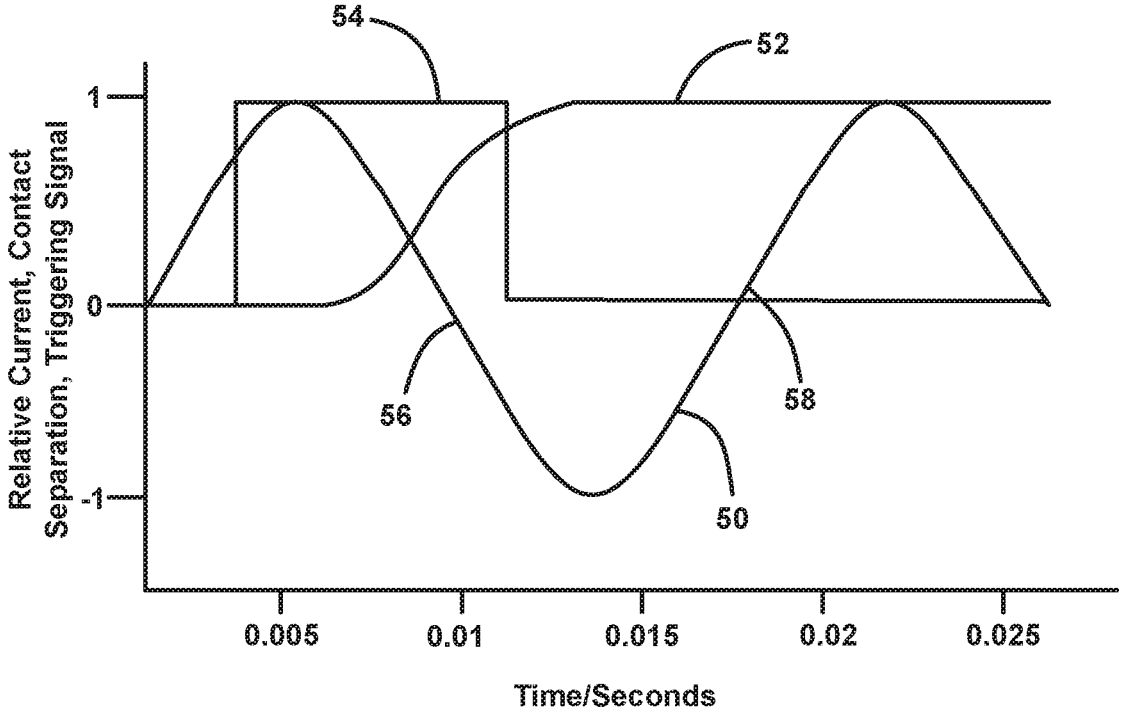
FIG. 3 is a graph time on the horizontal axis and current, contact separation and triggering signal on the vertical axis.

This concept is shown by the graph in FIG. 3, where time is on the horizontal axis and current, shown by graph line 50, contact separation, shown by graph line 52, and a triggering signal, shown by graph line 54, are on the vertical axis. If the circuit is interrupted at location 56 on the graph line 50, the contacts 16 and 22 are not far enough apart, and a restrike between the contacts 16 and 22 may occur. Continued triggering of the device 14 allows conduction until the contacts 16 and 22 have an adequate separation, such as by location 58 on the graph line 50, to withstand TRV at the next AC current signal zero point.

Figure 4:
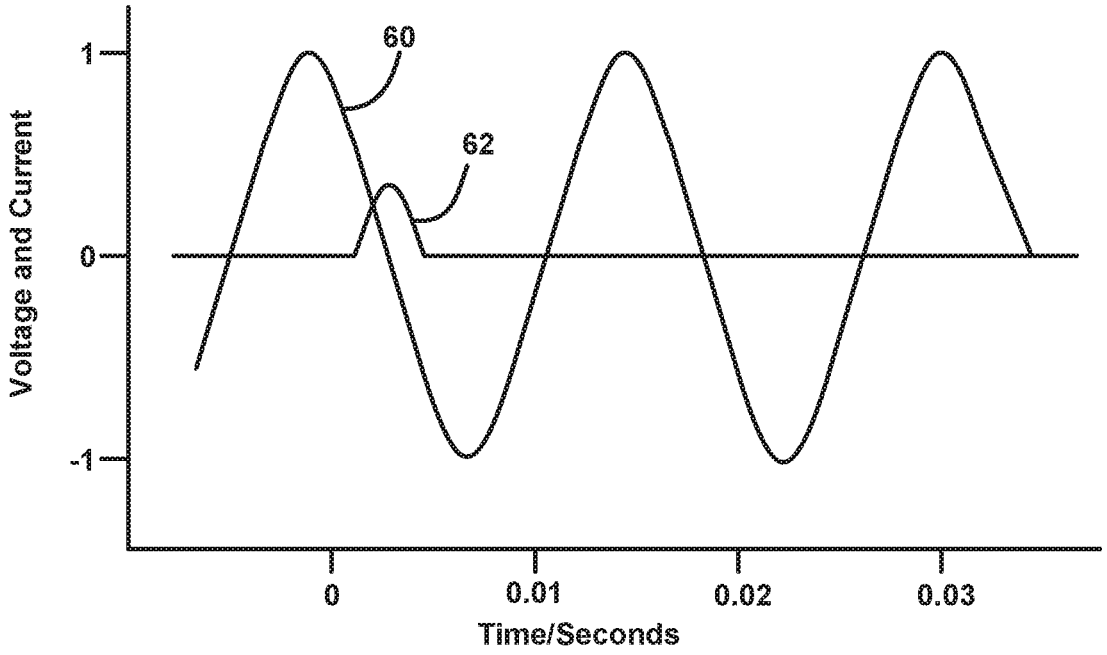
FIG. 4 is a graph with time on the horizontal axis and current and voltage on the vertical axis showing a triggering waveform.

As discussed for the third mode where the triggered gap device 14 is energized to conduct current for a short period of time, but the mechanical switch 12 remains open, pulse testing can be performed using the switch assembly 10 at high voltages with more accuracy, and with less power sent down the power line than what is possible with known switches. This allows for testing of high voltage and extra high voltage lines without reclosing, and therefore prevents closing on persistent faults. This pulse testing or pulse closing operation can be illustrated by the graph shown in FIG. 4, where time is on the horizontal axis and voltage and current are on the vertical axis. Graph line 60 is the voltage waveform of the AC power signal applied to the contact 30. The device 14 is triggered at pulse 62 and generates a current flow across the gap 36, where the size of the pulse 62 is highly controllable and tunable. Since the contacts 30 and 32 don't move, they can be placed far enough apart to withstand several hundred kV. It is noted that for the graph in FIG. 4, the voltage is measured line-to-ground for the particular phase.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. A switch assembly comprising:

a first electrical connection;

a second electrical connection;

a mechanical switch including a first switch contact electrically coupled to the first electrical connection and a second switch contact electrically coupled to the second electrical connection, where one or both of the first switch contact and the second switch contact are movable to engage and disengage the first and second switch contacts to make and break an electrical connection therebetween for allowing or preventing current flow between the first and second electrical connections; and a triggered gap device including a vacuum enclosure, a first stationary contact positioned within the enclosure and being electrically coupled to the first electrical connection and a second stationary contact positioned within the enclosure and being electrically coupled to the second electrical connection, where a gap is defined between the first and second stationary contacts, the triggered gap device further including a plasma control device that is operable to cause a plasma to be formed in the gap that creates an arc to allow current flow between the first and second electrical connections.

2. The switch assembly according to claim 1 wherein the plasma control device energizes a small cathode spot on one or both of the stationary contacts in the triggered gap device that emits a metal vapor into the gap that allows for the plasma to be formed.

3. The switch assembly according to claim 2 wherein the plasma control device is a laser.

4. The switch assembly according to claim 3 wherein the laser is positioned outside of the vacuum enclosure.

5. The switch assembly according to claim 1 wherein the plasma control device is an electrode that causes a spark to be generated which triggers continuous generation of the plasma.

6. The switch assembly according to claim 1 wherein the plasma control device is operable to allow creation of the plasma and cause the arc between the stationary contacts on the order of micro-seconds.

7. The switch assembly according to claim 1 wherein an AC power signal is applied to the first electrical connection, and wherein the plasma control device is triggered at a particular angle of the AC power signal and the plasma is naturally extinguished at a next zero crossing of the AC power signal.

8. The switch assembly according to claim 7 wherein the AC power signal is a high voltage signal.

9. The switch assembly according to claim 1 wherein the switch assembly operates as a fault interrupting switch where the mechanical switch is maintained open during a pulse closing operation.

10. The switch assembly according to claim 1 wherein the mechanical switch is a gas insulated switch.

11. A switch assembly for high voltage applications, the switch assembly comprising:

a first electrical connection that is responsive to an AC power signal;

a second electrical connection;

a mechanical switch including a first switch contact electrically coupled to the first electrical connection and a second switch contact electrically coupled to the second electrical connection, where one or both of the first switch contact and the second switch contact are movable to engage and disengage the first and second switch contacts to make and break an electrical connection therebetween for allowing or preventing current flow between the first and second electrical connections; and a triggered gap device including a vacuum enclosure, a first stationary contact positioned within the enclosure and being electrically coupled to the first electrical connection and a second stationary contact positioned within the enclosure and being electrically coupled to the second electrical connection, where a gap is defined between the first and second stationary contacts, the triggered gap device further including a plasma control device that is operable to energizes a small cathode spot on one or both of the stationary contacts that emits a metal vapor into the gap to allow creation of a plasma that causes an arc across the gap that allows current flow between the first and second electrical connections, wherein the plasma control device is triggered at a particular angle of the AC power signal and the plasma is naturally extinguished at a next zero crossing of the AC power signal.

12. The switch assembly according to claim 11 wherein the plasma control device is a laser.

13. The switch assembly according to claim 12 wherein the laser is positioned outside of the vacuum enclosure.

14. The switch assembly according to claim 11 wherein the plasma control device is an electrode that causes a spark to be generated which triggers continuous generation of the plasma.

15. The switch assembly according to claim 11 wherein the plasma control device is operable to cause the arc between the stationary contacts on the order of microseconds.

16. The switch assembly according to claim 11 wherein the switch assembly operates as a fault interrupting switch where the mechanical switch is maintained open during a pulse closing operation.

17. The switch assembly according to claim 11 wherein the mechanical switch is a gas insulated switch.

18. A switch assembly comprising:

a first electrical connection that is responsive to an AC power signal;

a second electrical connection; and a triggered gap device including a vacuum enclosure, a first stationary contact positioned within the enclosure and being electrically coupled to the first electrical connection and a second stationary contact positioned within the enclosure and being electrically coupled to the second electrical connection, where a gap is defined between the first and second stationary contacts, the triggered gap device further including a plasma control device that is operable to energizes a small cathode spot on one or both of the stationary contacts that emits a metal vapor into the gap to allow creation of a plasma that causes an arc across the gap that allows current flow between the first and second electrical connections, wherein the plasma control device is triggered at a particular angle of the AC power signal and the plasma is naturally extinguished at a next zero crossing of the AC power signal.

19. The switch assembly according to claim 18 wherein the plasma control device is a laser.

20. The switch assembly according to claim 18 wherein the plasma control device is an electrode that causes a spark to be generated which triggers continuous generation of the plasma.

* * * * *